US005182608A

United States Patent [19]

Kroll et al.

[11] Patent Number: 5,182,608

[45] Date of Patent: Jan. 26, 1993

[54] METHOD AND APPARATUS FOR APPLYING TONER TO AN ELECTROSTATIC IMAGE

[75] Inventors: Arthur S. Kroll; Arthur E. Dunn, both Rochester; Michael L. DeCecca, Fairport; David M. Gaudino, Rochester; Jerry E. Livadas, Webster; David R. McDougal, Fairport; James G. Rydelek, Rochester, all of N.Y.

[73] Assignee: Eastman Kodak Company, Rochester, N.Y.

[21] Appl. No.: 621,681

[22] Filed: Dec. 3, 1990

[51] Int. Cl.[5] ..... G03G 15/01

[52] U.S. Cl. ..... 355/326; 118/645; 118/657; 118/658; 355/251

[58] Field of Search ..... 355/245, 256, 251, 326, 355/327, 328; 118/645, 657, 658

[56] References Cited

U.S. PATENT DOCUMENTS

| | | | |
|---|---|---|---|
| 3,981,576 | 9/1976 | Inoue | 355/327 X |
| 4,702,588 | 10/1987 | Hatabe et al. | 355/326 |
| 4,754,302 | 6/1988 | Komatsubara et al. | 118/660 X |
| 4,841,329 | 6/1989 | Kasamura et al. | 355/245 |
| 5,053,820 | 10/1991 | Preszler et al. | 355/245 |
| 5,111,245 | 5/1992 | DeCecca et al. | 355/326 X |

FOREIGN PATENT DOCUMENTS

| | | | |
|---|---|---|---|
| 0069670 | 4/1985 | Japan | 355/251 |

*Primary Examiner*—A. T. Grimley
*Assistant Examiner*—J. E. Barlow, Jr.
*Attorney, Agent, or Firm*—Leonard W. Treash, Jr.

[57] ABSTRACT

A series of electrostatic images carried by a drum or similar image member are toned with different colored toners by a movable developing device. The developing device moves a series of developing units to a position aligned with the drum. An applicator is an aligned unit is moved relative to the rest of the unit toward the drum to operatively position the unit for developing each electrostatic image.

37 Claims, 9 Drawing Sheets

METHOD AND APPARATUS FOR APPLYING TONER TO AN ELECTROSTATIC IMAGE

FIELD OF THE INVENTION

This invention relates to the development of electrostatic images. It is particularly useful in developing a series of electrostatic images with different toners, for example, different color toners.

BACKGROUND ART

U.S. Pat. No. 4,928,146 issued to Yamada on May 22, 1990, is illustrative of a number of references which show the development of a series of electrostatic images carried on a photoconductive drum with different colored toners at a single development position. See also, U.S. Pat. No. 3,797,930, Tanaka et al, issued Mar. 17, 1974; U.S. Pat. No. 4,275,134, Knechtel, issued Jun. 23, 1981; Japanese Kokai 1-244477 (1989); U.S. Pat. No. 4,728,983, Zwaldo, issued Mar. 1, 1988. A series of four development stations are moved one after another to the development position. Each station develops an image and is replaced by another station as the series of stations is indexed to apply a different color toner to the next image. The series of stations are arranged side-by-side and moved linearly through a position in which the station to be used is aligned with the development position. After or as it is aligned, a cam is rotated to push the entire station toward the development position, generally moving transverse to the motion of the series of stations. Other references show the stations arranged on a rotary support with the stations being rotated through alignment with the development position.

This general approach has the advantage of utilizing only a single development position for applying four different color toners to electrostatic images. This permits the use of development stations whose size and number would prohibit them being spaced around the periphery of a relatively small photoconductive drum. It thus also permits the use of a small photoconductive drum in multicolor imaging. The use of a small drum has many advantages including reduced expense, reduced size of the apparatus and convenience in cartridge type replacement.

The structure shown in the prior art requires two motions on the part of each development unit. The four units are moved as one linearly in one direction and the unit opposite the development position is moved relative to the others transverse to that motion into operative relationship with the photoconductive drum. This second movement requires that the units be mounted so that they are movable relative to each other and also requires a separate moving mechanism for moving them, which moving mechanism must be properly timed and driven, and must be powered sufficiently to move an entire unit.

U.S. Pat. Nos. 4,922,302, issued to Hill et al, on May 1, 1990; 4,884,109, issued to Hill et al, on Nov. 28, 1989; and 4,797,704, issued to Hill et al, on Jan. 10, 1989; show a development station having an applicator with a rotating magnetic core and a stationary nonmagnetic sleeve around which a developer mixture is moved by rotation of the core to pass the developer through a development position. The applicator is fed by a rotating paddle positioned below the applicator which both mixes developer and supplies it to the applicator. Toner is periodically supplied to the mixture from a toner supply portion of the station. New toner is supplied by replacing the station.

DISCLOSURE OF INVENTION

It is the object of the invention to provide both method and apparatus for developing a series of electrostatic images with different color toners with a simplified design.

These other objects are accomplished by providing a development unit which includes an applicator for applying developer to an electrostatic image which applicator is movable toward a development position with respect to the rest of the unit.

According to a preferred embodiment, this invention is incorporated in apparatus in which a plurality of such units are fixed with respect to each other and moved linearly to align the respective units one after another with a development position. The applicator of an aligned unit is then moved toward the development position with respect to the rest of the unit to facilitate development of an electrostatic image.

With this structure, the moving means does not need to move the entire unit, thereby requiring considerably less energy to accomplish that objective. The units themselves can be fixed with respect to each other, a structure which has many advantages in design and in reliability (and which advantages are discussed in more detail with respect to the preferred embodiments below). Preciseness in positioning of the applicator with respect to a surface carrying an electrostatic image is facilitated, which is illustrated in the preferred embodiments below.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
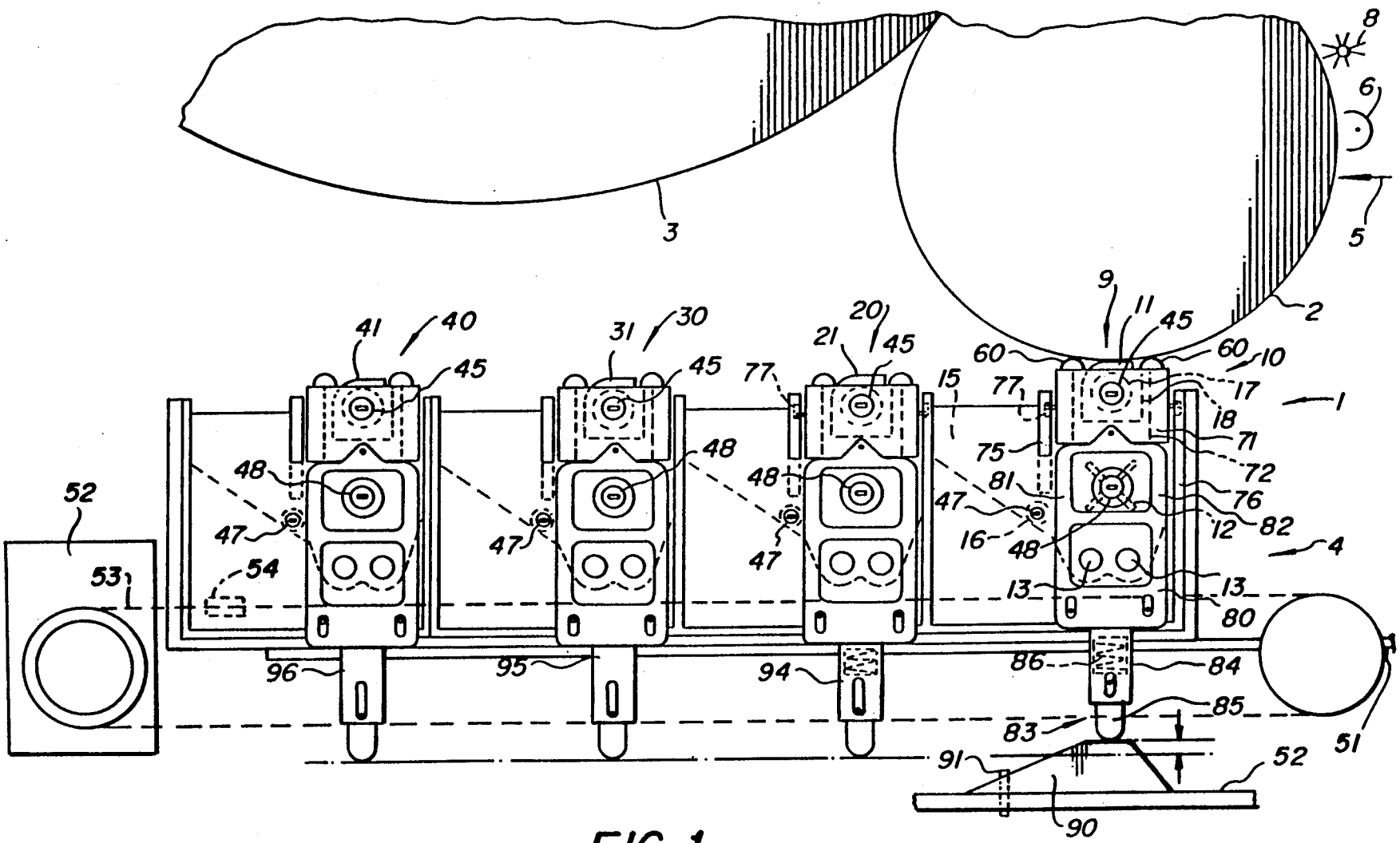
FIG. 1 is a front schematic of a portion of a color printer with many parts eliminated for clarity of illustration.

According to FIG. 1 an electrophotographic color printer 1 includes a photoconductive drum 2 mounted for rotation past a series of stations to create multicolor toner images on a transfer roller 3 or a receiving sheet carried by transfer roller 3, according to a process well-known in the art. More specifically, drum 2 is uniformly charged at a charging station 6, imagewise exposed at an exposure station, for example, a laser exposure station 5 to create a series of electrostatic images. The electrostatic images are developed by developing device 4 which applies a different color toner to each of the series of images to form a series of different color toner images. The series of toner images are then transferred in registration to a surface associated with transfer roller 3 to create a multicolor toner image. The surface associated with roller 3 can either be the surface of transfer roller 3 or the outside surface of a receiving sheet secured to the surface of roller 3. If the multicolor image is formed directly on the surface of transfer roller 3, it is best utilized by being transferred to a receiving sheet at a position remote from drum 2 by a means not shown. If the multicolor image is formed on the surface of a receiving sheet carried by roller 3, that sheet is separated from roller 3, also at a position remote from drum 2, also by a means not shown.

Photoconductive drum 2 is made quite small, its periphery being substantially smaller than a single image A small photoconductive drum allows it to be easily replaced, for example, replaced as part of a process cartridge which can also include charging station 6 and a cleaning station 8. It also contributes to a reduction of the size and cost of the printer 1. Unfortunately, smallness in the photoconductive drum makes application of different color toners to consecutive electrostatic images difficult to accomplish geometrically. Similar to the prior art cited above, printer 1 solves this problem by moving a series of four development units 10, 20, 30 and 40 through a development position 9 allowing each of the electrostatic images to be toned by a different developing unit but using only a single developing position 9 associated with the drum 2.

According to FIG. 1 the development units 10, 20, 30, and 40 are all fixed in a laterally moveable carriage 50. Carriage 50 is supported on guide rails 51 for linear movement in a horizontal direction below drum 2. Carriage 50 is driven by a motor 52 through a metal drive tape 53 fixed to carriage 50 at 54.

In FIG. 1, developing unit 10 is shown aligned with development position 9. Preferably, carriage 50 has a start position to the left of the position shown in FIG. 1 and moves to the position shown in FIG. 1 to develop the first electrostatic image of a series. When that image is toned, the carriage again is moved to align developing unit 20 for toning the second electrostatic image. Units 30 and 40 are similarly aligned with position 9 to tone the third and fourth electrostatic images. The carriage 50 is then returned to its start position.

Developing unit 10 includes an applicator 11, a mixing device, for example, paddle 12 and augers 13. The mixing device is located in a development chamber 14 which includes a mixture of hard magnetic carrier particles and insulating toner particles. A supply of toner is contained in a toner chamber 15. Toner is fed from the toner chamber 15 to the development chamber 14 by a toner feed roller 16.

Construction and operation of each unit is essentially the same as the unit described in U.S. Pat. No. 4,797,704, referred to above, the disclosure of which patent is incorporated by reference herein. In operation, rotation of paddle 12 and augers 13 cause both the mixing of developer in chamber 14 and a raising of the level of that developer making it accessible to the magnetic field of applicator 11. Applicator 11, as described more thoroughly in the above patent, includes a rotatable magnetic core 17 and a stationary sleeve 18. Hard magnetic carrier particles move around the sleeve 18 in response to rotation of the core bringing the developer through developing position 9. The developer is moved by the rotating core at essentially the same speed as the electrostatic image is moving on rotating drum 2 providing high quality development of the electrostatic image. Development units 20, 30 and 40 are of essentially the same construction, although note that the toner chamber 45 of developing unit 40 is larger than the other toner chambers. The development unit 40 contains black toner which is used more often than the color toners in units 10, 20, and 30. Units 10, 20 and 30 can have cyan, magenta and yellow toners for doing full color reproductions or could hold highlight color toners, for example, red, blue and yellow.

The development system utilized by development units 10, 20, 30 and 40 requires a small precise spacing between the sleeve 18 of applicator 11 and the drum 2. This is accomplished, according to FIG. 1, by four rollers 60, one on each side of the applicator on each end of unit 10. Rollers 60 are precisely positioned and sized so that, when urged against drum 2 as shown in FIG. 1 with unit 10, they precisely space applicator 11 with respect to drum 2.

In the prior art cited above, each developing unit is aligned with a developing position. Either after it is aligned or as it is aligned, the unit is moved with respect to the other units toward the development position to engage a photoconductive drum. This latter movement requires that each of the developing units be movable with respect to each other. It requires a separate driving means such as a rotatable cam for moving each separate unit, which means must be timed with the drive means for the aligning movement.

The developing device 4 according to FIG. 1 substantially improves on this prior apparatus by fixing the development units 10, 20, 30 and 40 with respect to each other in the carriage 50. As each developing unit becomes aligned with developing position 9, the applicator 11 is moved with respect to the rest of the unit toward drum 2 to seat rollers 60 on drum 2.

To accomplish this objective, applicator 11 is mounted on an applicator block 71 to form with applicator 11 and rollers 60, an applicator assembly. Applicator block 71 has an opening 72 in which applicator 11 is mounted. Opening 72 is larger than applicator 11 allowing developer from chamber 14 to move around sleeve 18 during development of an image. Applicator block 71 is loosely mounted in side walls 75 and 76 by mounting means 77 which allow limited movement of block 71 in a vertical direction. The side walls of block 71 fit loosely against side walls 75 and 76 allowing some lateral and tilting movement of block 71. A pair of lifters 80 are pivotably attached to opposite ends of the applicator block 71 and loosely attached to the ends of unit 10. Similar lifters are associated with units 20, 30 and 40.

Directly below each lifter 80 in carriage 50 is an engaging pin 83. Engaging pin 83 includes a sleeve 84, a pin core 85 mounted within sleeve 84 and a spring 86 within sleeve 84 urging pin core 85 in a downward direction. A pin and slot in pin core 85 and sleeve 84, respectively, prevent movement of pin core 85 out of sleeve 84. A pair of wedges 90 are pivotally secured to the base of the printer by pivots 91 and are aligned with the front and rear series of engaging pins, respectively.

As carriage 50 is moved from left to right as shown in FIG. 1, each of engaging pins 83 engages one wedge 90 as developing unit 10 becomes aligned with developing position 9. Engagement of pin 83 with wedge 90 forces core 85 in an upward direction against the force of spring 86. Spring 86 then urges the top of sleeve 84 against lifter 80 to urge lifter 80 in an upward direction against applicator block 71. Block 71 is moved upward until rollers 60 rest against drum 2 to position applicator 11 at the development position accurately spaced from drum 2. After development of a first electrostatic image, motor 52 is actuated again to drive carriage 50 further to the right. Gravity and two of rollers 60 urge block 71 and lifter 80 down to its original position. This movement can be assisted by a cantilever spring (not shown) urging block 71 downward against spring 86. Motor 52 drives carriage 50 to the right until applicator 21 of developing unit 20 becomes aligned with exposure position 9 and engaging pins 94 engage wedges 90 to move applicator 21 into appropriate position for toning a second electrostatic image. The process is repeated for developing units 30 and 40 with applicators 31 and 41 being moved into position in response to engagement of wedges 90 by engaging pins 95 and 96 respectively.

Note that if a slight amount of misalignment of unit 10 occurs, the loose mounting of block 71 between side walls 75 and 76 and the pivotal attachment of block 71 to lifter 80 allows some tilting and lateral movement of the block to accurately space applicators 11, 21, 31 and 41 as controlled by roller 60 on the surface of drum 2.

Figure 3:
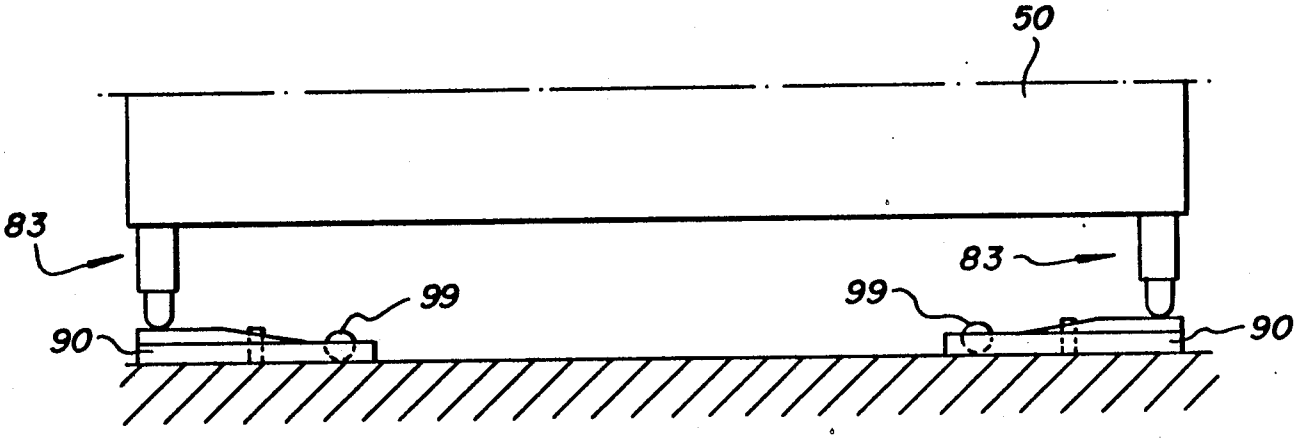
FIG. 3 is a right side view of a portion of the developing device shown in FIG. 2 with parts eliminated for clarity of illustration.

Motor 52 is reversed after all four images have been toned and the carriage 50 is returned to the left to its original position. During that return movement, to avoid interaction between the developing units and the drum, wedges 90 are pivoted out of the path of engaging pins 83, 94, 95 and 96 by solenoids 99 (see FIG. 3).

Alternatively, wedge 90 can be made symmetrical and a set of images toned on the return movement. This would require that every other set of images be exposed in an order reverse of the other sets of images. Alterations of this nature in the order of exposures in an electronic printer involves programming design well within the skill of the art.

Figure 2:
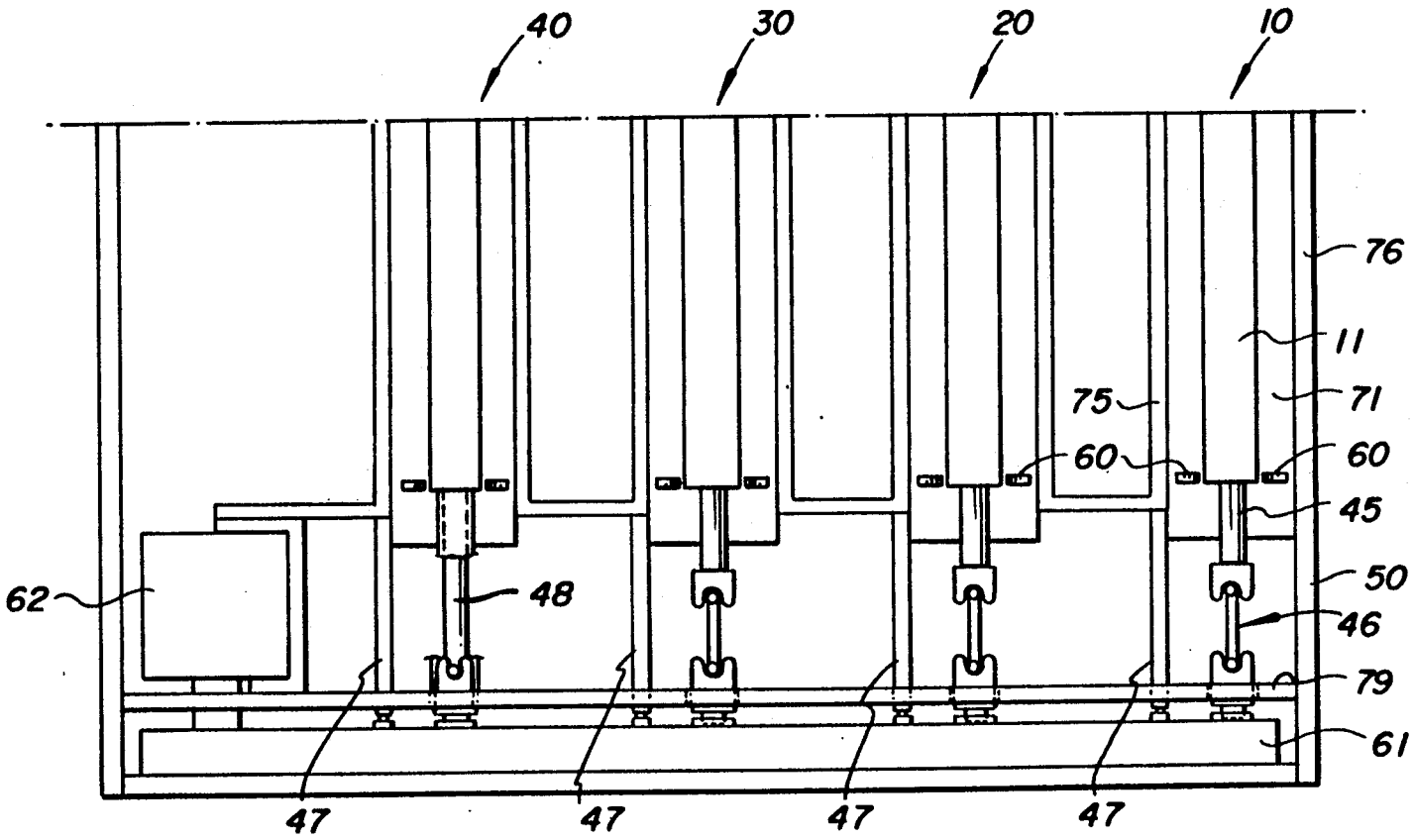
FIG. 2 is a top view, partially schematic, of a developing device of the printer shown in FIG. 1 with many parts eliminated for clarity of illustration and a few parts changed for variety of illustration.

FIG. 2 illustrates some of the advantages of moving only the applicator relative to the rest of the unit to finally position the applicator with respect to the drum at the development position 9. The applicator 11 has a rotatable magnetic core which must be driven during development. Typically it is driven at a speed of 1000 to 1300 revolutions per minute. Paddle 12 is driven at a much slower speed, for example, 50 to 300 revolutions per minute. Augers 13 are generally geared to paddle 12 within the unit itself. Development feed roller 16 is rotated a few rotations when toner is fed according to a program or demand from a toner monitor or pixel count of the printer. Development units such as these typically have three separate connections to one or more drive means to rotate these components; see, for example, U.S. Pat. No. 4,797,704 referred to above. An alternative to separate drives would be to gear the components together within each unit with a clutch actuable for occasional engagement of the toner feed roller. This latter approach would make each development unit unduly complex, especially with the substantial gear reductions required.

However, if the entire unit is moved with respect to the other units for final positioning of the applicator, each of the drive couplings for the moving station would have to absorb that movement. Moving only the applicator means that only one coupling for each unit need be of this complexity.

This is illustrated in FIG. 2. Applicator 11 includes a shaft 45 for driving rotatable magnetic core piece 17 (FIG. 1) which is connected by a universal coupling 46 through a loose fitting in a coupling wall 79 to a drive train 61. Note that seating of rollers 60 on drum 2 may cause some tilting or skewing of applicator block 71 with respect to side walls 75 and 76. Universal coupling 46 must absorb that possible movement as well as the more substantial vertical movement as the block is pushed up by engagement of the engaging pins 83 with the wedges 90 (FIG. 1). Because the units 10, 20, 30 and 40 are fixed with respect to each other (except for the applicator assemblies), the drive couplings to the paddles, for example, paddle 12, and the feed rollers, for example, feed roller 16, can be made as less expensive fixed couplings. For example, shafts 47 driving feed rollers 16 can extend from each development unit through walls 79 to drive train 61 without the need for a universal coupling or a loose fit with wall 79. Similarly, shafts 48 (shown in FIG. 2 only with respect to unit 40) are connected by a similarly fixed coupling to drive train 61. Drive train 61 is driven by a single motor 62 and includes clutches for each of shafts 47 to control toner feed according to program or demand.

As illustrated in FIG. 2, units 10, 20, 30 and 40 are made as a single integral component. It is removable as a unit from carriage 50. Walls between stations serve as a single wall for both stations. While this has many advantages in cost, weight, space and simplicity, it may be advantageous to have the black toner station 40 separately replaceable from the other three stations, since consumption of black toner is likely to be substantially different from consumption of the other three toners. Thus, one or all of the stations can be made separately removable. In such instance, a single wall would not be common for two stations and the carriage 5 would be provided with sufficient structure to nest each of the separately removable stations. This is best illustrated in FIG. 1 where units 10, 20 and 30 are a single removable integral unit containing cyan, magenta and yellow (for example) toners. Station 40 has its own separate walls and is separately removable and contains black toner.

Figure 15:
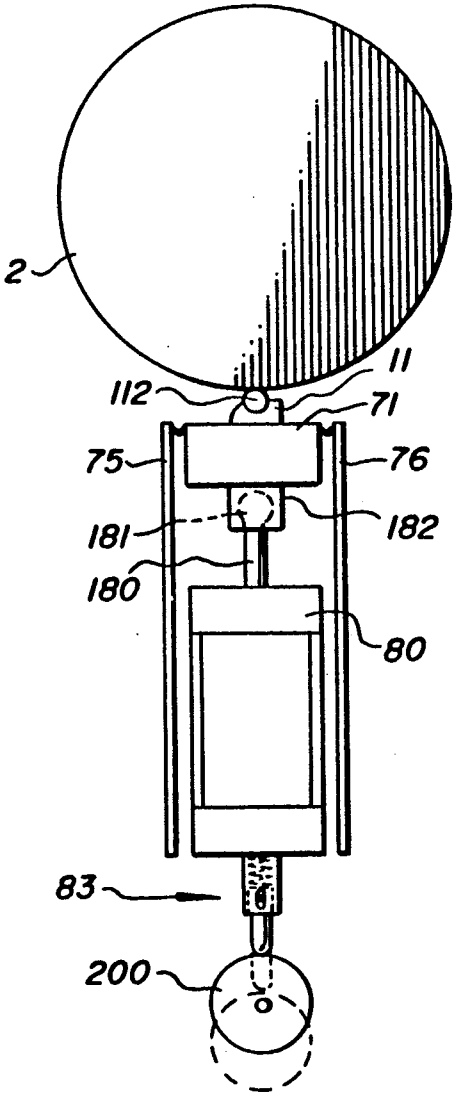
FIG. 15 is a front view illustrating a preferred lifter mechanism for the structure shown in FIG. 5.

Each applicator assembly, including an applicator block and an applicator is a small fraction of the weight of the entire developing unit including developer. Thus, spring 86 which provides the force for moving the applicator assembly into engagement with drum 2 can be of an appropriate modest strength. However, the utilization of wedges 90 in combination with engaging pins 83 to raise the applicator assembly is a scheme that could also be used to raise the entire unit if the units are constructed generally according to the prior art in which the entire unit has to be moved for final transverse positioning. In this instance, spring 86 must be of much greater magnitude. In each instance, wedges 90 provide an advantage of using the energy from motor 52 to provide the transverse movement of the unit, thus eliminating the separate drive conventionally used for that movement (and as shown in FIG. 15). Thus, the wedge 90 and engaging pin 83 concept can be used both in the structure shown in all the FIGS. and also with the prior art structures. However, because of the lightness of the applicator assembly compared to the weight of the entire unit, this concept has particular application to the structure shown in the FIGS.

Figure 4:
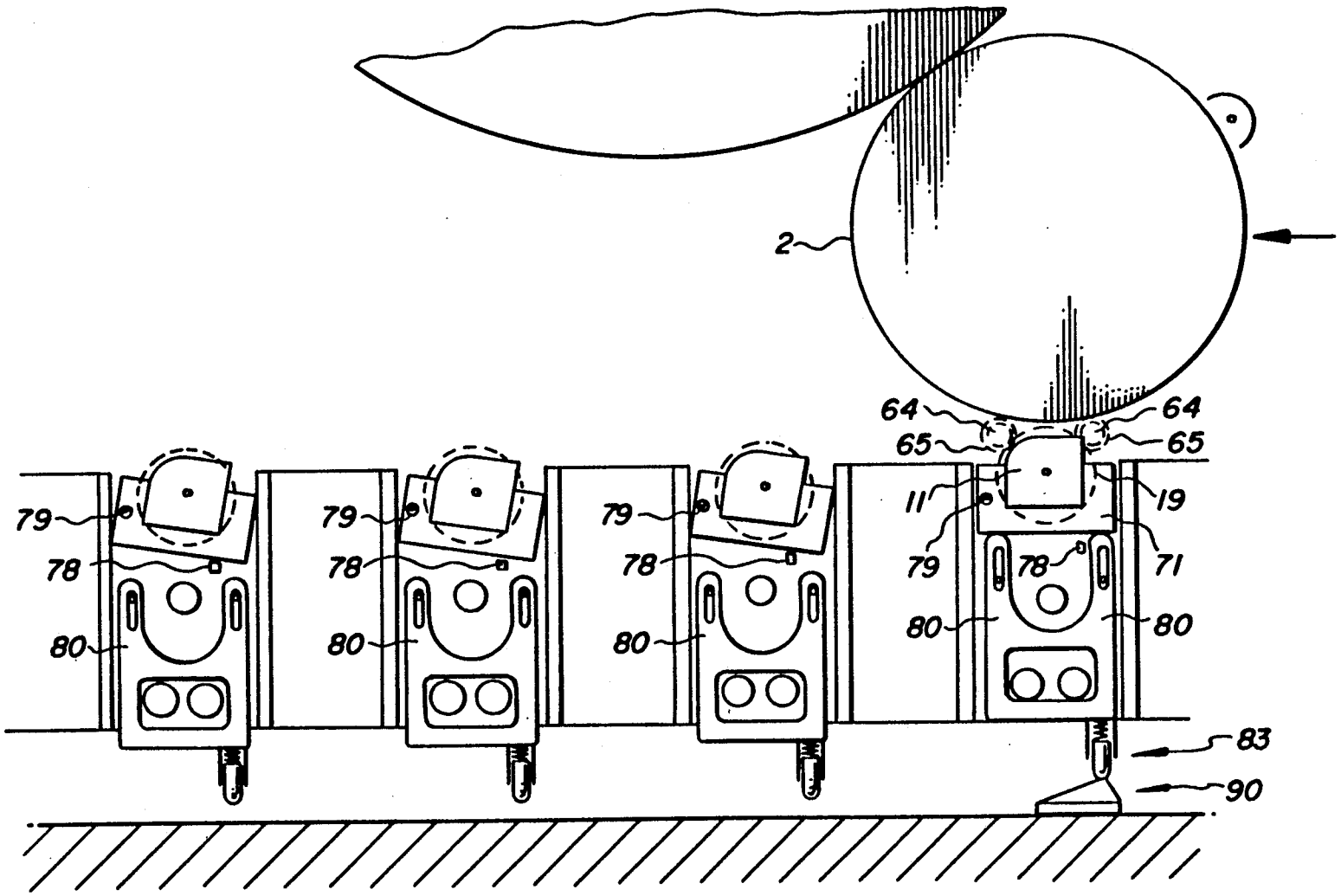
FIG. 4 is a front schematic similar to FIG. 1 showing an alternative construction of some portions.

FIG. 4 illustrates an alternative embodiment in which applicator blocks 71 are each pivotally mounted between a pivot 79 and a stopping lug 78. FIG. 4 also illustrates a different concept for positioning applicator 11 with respect to drum 2. Applicator 11 (and each of the other applicators) includes a disk 19 which can be mounted concentrically with the magnetic core shaft 45 (FIG. 1) which seats on a pair of shafts 64 at each end of drum 2. Shafts 64 have rollers 65 mounted on them and are urged toward drum 62 by means not shown. Rollers 64 roll on drum 2 and provide a permanent means for engagement of disks 19 as applicator block 71 is pushed in its transverse direction. Pivot 79 should be a relatively loose pivot between a thin pin and a substantially larger hole which permits some adjustment for slight misalignments of the position of block 71 in response to contact of disks 19 and shafts 65. Shafts 64 and rollers 65 are not part of the development device 4, but can be part of the printer and/or drum structure.

Figure 6:
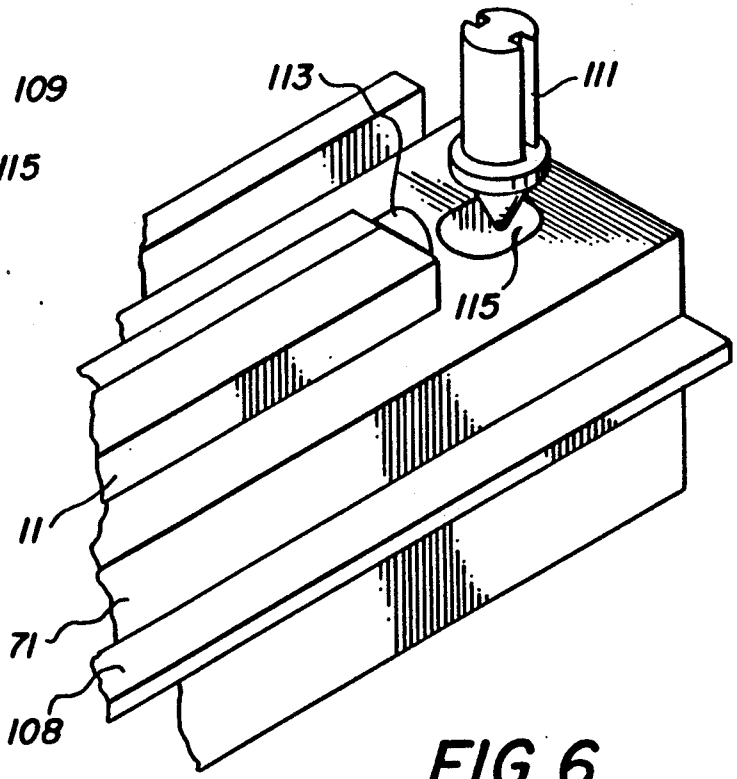
FIG. 6 is an enlarged view of a portion of the apparatus shown in FIG. 5.
Figure 5:
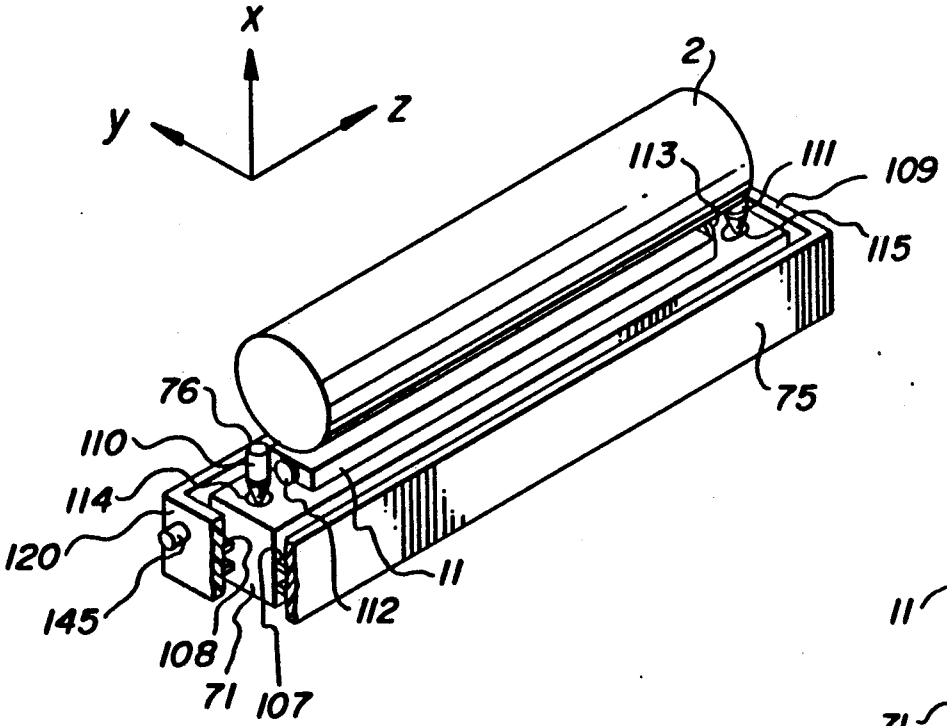
FIG. 5 is a perspective view of a portion of the apparatus shown in FIGS. 1 and 2 illustrating an alternative structure for positioning an applicator with respect to an image member.
Figure 7:
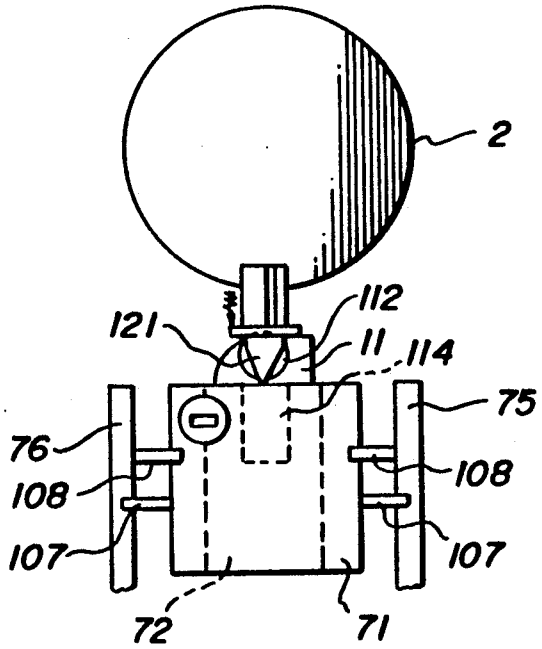
Figure 10:
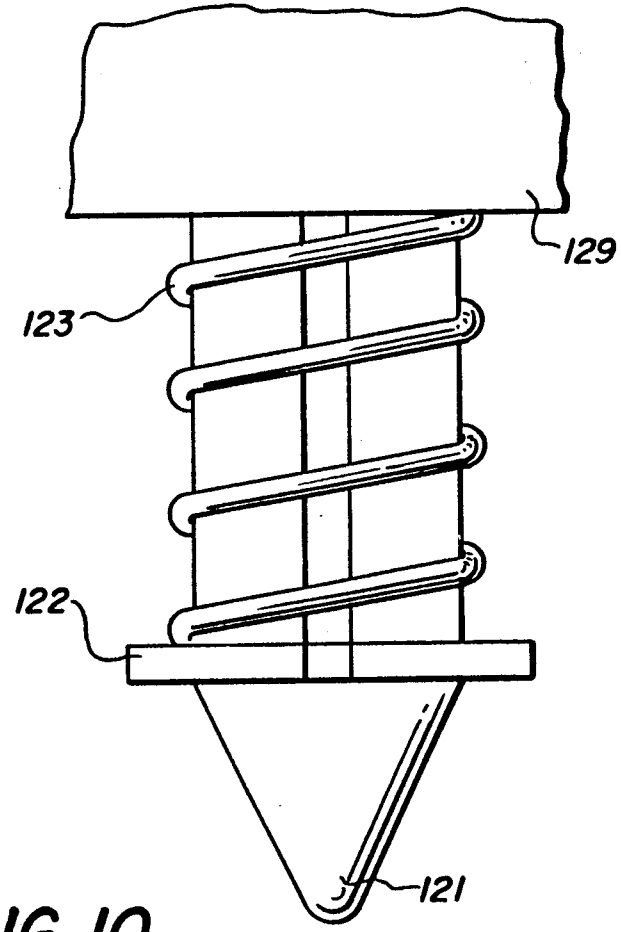
FIGS. 10 and 11 are left side views of positioning pin 110 together with a portion of its cooperating structure, including a cross-section of hole 114.
Figure 9:
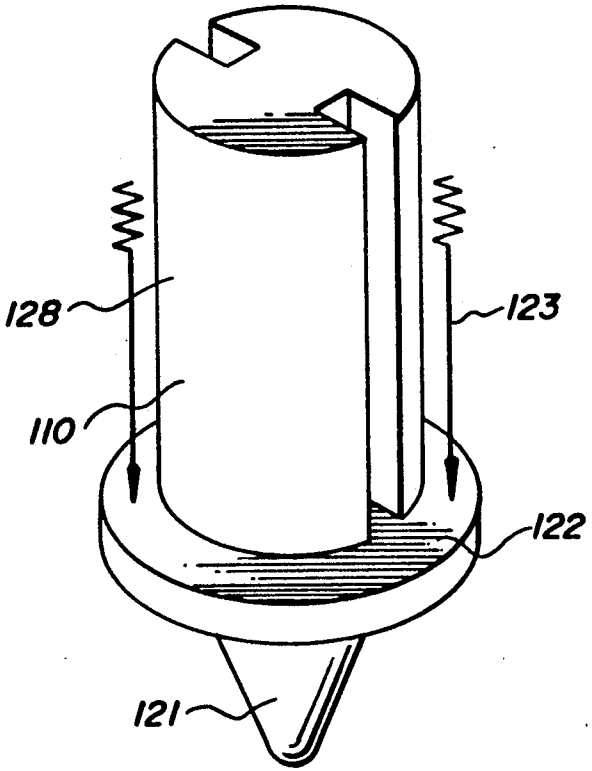
FIG. 9 is a perspective view of a positioning pin shown in FIGS. 5 and 6.

FIGS. 5-15 illustrate an alternative preferred embodiment for positioning applicator 11 with respect to drum 2. It also illustrates a preferred seating mechanism between block 71 and side walls 75 and 76 which can also be employed in the FIG. 1 embodiment. Referring to FIGS. 5-7, block 71 is movably positioned between walls 75, 76, 109 and 120. To prevent developing material from escaping around the block, a labyrinth seal is provided by felt members 107 and 108 which completely encircle block 71. Felt member 107 is attached to walls 75, 76, 109 and 120 and felt member 108 is attached to block 71 (as best illustrated with respect to walls 75 and 76 in FIG. 5). Felt members 107 and 108 prevent toner from escaping around block 71 and also frictionally hold block 71 between walls 75, 76, 109 and 120 while permitting a full range of movement as the applicator 11 is positioned in operative position with respect to drum 2.

As shown in FIG. 7, pads or seals 107 and 108 each have surfaces which slide on either wall 75, 76, 109 and 120 or on the side walls of block 71. Those surfaces that slide can be coated with a polytetrafluoroethylene or similar low surface adhesion material to permit easy movement of block 71 and less wear to pads 107 and 108.

Figure 13:
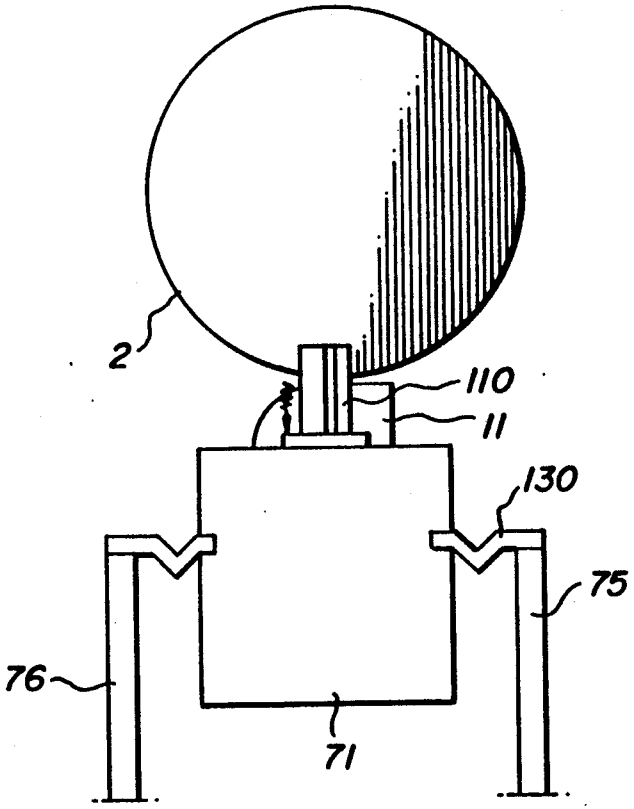
FIG. 13 is a front view similar to FIG. 7 illustrating an alternative sealing structure for applicator 71 to that shown in FIG. 7.

FIG. 13 illustrates another embodiment in which the foam pads 107 and 108 are replaced by a bellows 130 which, like the pads 107 and 108, extend completely around applicator block 71. Bellows 130 can be made of any suitable rubber, plastic or cardboard bellows material and secured by adhesives to both applicator block 71 and side walls 75, 76, 109 and 120.

Accurate positioning of applicator 11 with respect to drum 2 is accomplished in the embodiment shown in FIGS. 5-15 by a pair of pins 110 and 111 which are fixed with respect to drum 2 and a pair of rollers 112 and 113 which are fixed with respect to applicator 11 and a pair of holes 114 and 115 in block 71 which are also fixed with respect to applicator 11.

As applicator block 71 is moved upward by lifter 80 (FIG. 1) pins 110 and 111 enter holes 114 and 115, respectively. Pins 110 and 111 are shown in more detail in FIGS. 9-12. Each pin includes a conical point 121, a washer 122 which slides on a cylindrical portion 128 and a spring 123 which spring is mounted between washer 122 and a housing 129 for drum 2 to which the pin is fixed. The cylindrical portion 128 of each pin is slotted to prevent washer 122 from sliding off point 121. Pins 110 and 111 are mounted to be accurately aligned with each other and the axis of rotation of drum 2. In the preferred embodiment shown, they are vertically oriented, with the development position at the bottom of drum 2.

Figure 11:
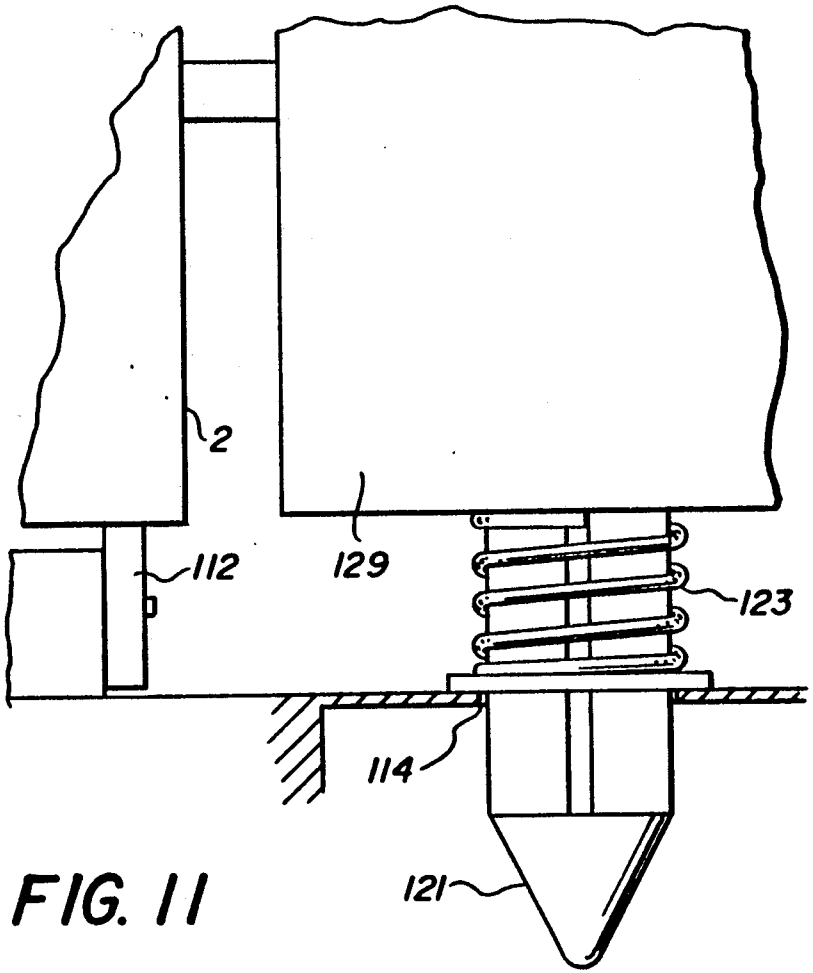

Hole 114 is circular in cross-section and sized to fit the cylindrical portion of pin 110. As seen in FIG. 11, the walls of hole 114 have a minimal depth and thus do not constrain the direction of pin 110 and therefore do not overconstrain the positioning system. Pin 110 thus can be skewed with respect to the top of block 71.

Figure 12:
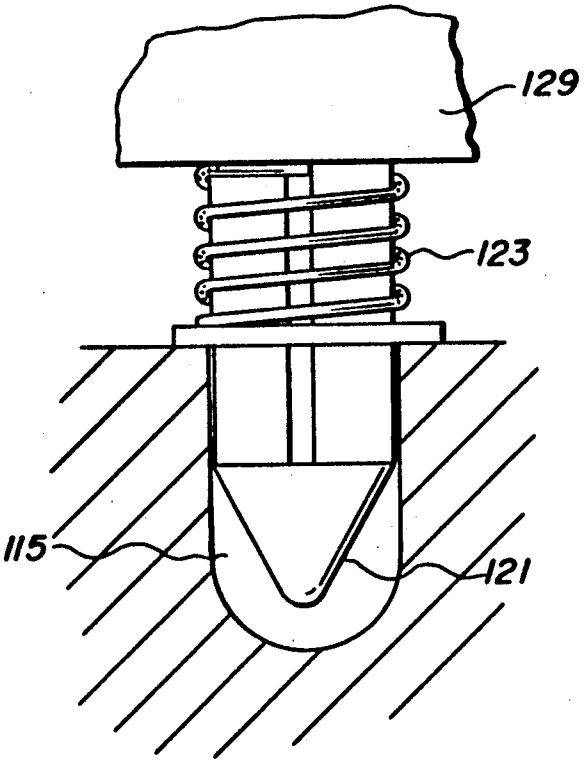
FIG. 12 is a rear view of pin 111 and a cross-section of hole 115.

Hole 115 is a slot with its long dimension running parallel to the axis of rotation of drum 2 and with a dimension across the slot that also fits the cylindrical portion of pin 111. As shown in FIG. 12, and unlike hole 114, hole 115 has side walls with sufficient depth to control the direction of pin 111 with respect to the walls. Holes 114 and 115 are centered on the axis of rotation of rotatable magnetic core 17 (FIG. 1). Thus, when the pins are seated in the holes the axes of rotation of the drum and core will be parallel.

Figure 8:
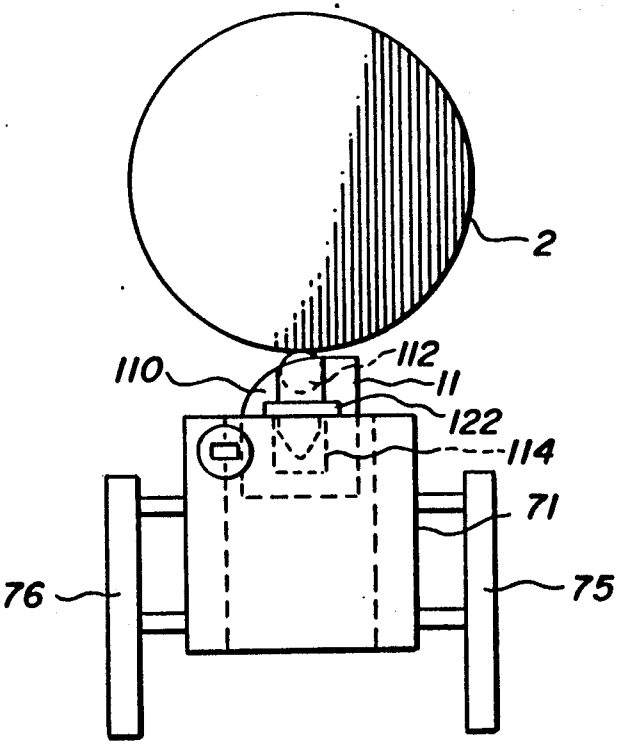
FIGS. 7 and 8 are front views of the portion shown in FIG. 5 with some parts eliminated for clarity of illustration.

Rollers 112 and 113 are mounted on the portion of the end faces of applicator 11 that extend above applicator block 71 and have an axis of rotation spaced directly above the axis of rotation of the rotatable magnetic core 17. Thus, as shown in FIG. 8, all of the key mounting elements are vertically aligned.

FIG. 5 includes reference axes x, y and z for describing the positioning of the applicator 11 with respect to drum 2. The z axis is parallel to the axis of rotation of drum 2. The x axis is orthogonal to the z axis in a plane including the axis of rotation of drum 2 and the development position. In the FIG. 5 embodiment it is vertical. The y axis is orthogonal to the x and z axes.

As lifters 80 push block 71 in an upward direction, pins 110 and 111 enter holes 114 and 115 until rollers 112 and 113 engage drum 2. At this point, pin 110 and hole 114 have established the linear position of applicator 11 in the y and z directions and with pin 111 and hole 115 have established its rotational position about the x axis. Engagement of rollers 112 and 113 with the drum have established the spacing between the applicator and the drum, that is, the linear position of the applicator 11 in the x direction as well as rotation about the y axis. Rotation about the z axis is established by pin 111 and the deep side walls of hole 115 (FIG. 12). The axes of rotation of the drum and core are parallel.

The spring 123 urging separation of washer 122 and a drum cartridge 129 is weaker than the springs 86 urging lifters 80 in an upward direction. When engaging pins 83 are no longer displaced upward and springs 86 are no longer urging lifters 80 in an upward direction, the force of springs 123 urging washers 122 in a downward direction assist gravity in pushing applicator block 71 also in a downward direction to move rollers 112 and 113 away from drum 2 and begin to remove pins 110 and 111 from holes 114 and 115 so that carriage 50 can move to bring the next unit to a position aligned with development position 9.

Pins 110 and 111 should be mounted on the same structure on which drum 2 is mounted. As shown in FIG. 11, if drum 2 is enclosed in a cartridge 129 allowing easy replacement of drum 2 when worn out, pins 110 and 111 should be secured in a wall of that cartridge and accurately positioned in manufacture of the cartridge 129 with respect to the axis of rotation of drum 2. This is illustrated schematically in FIG. 11. Notice that one of the dimensions most critical for operation of the development mechanism, the separation between the applicator 11 and the drum 2 is maintained by direct contact between rollers 112 and 113 and the drum periphery itself. The accuracy of this separation is dependent upon accuracy in the location of rollers 112 and 113 with respect to applicator 11. Rollers 112 and 113 can be applied to applicator 11 as part of its manufacturing process, thereby assuring this critical spacing. FIG. 8 illustrates the condition in which applicator 11 is operatively positioned with respect to drum 2 with its separation controlled by rollers 112 and 113 (only roller 112 being shown in FIG. 8).

The other positioning means, pins 110 and 111 and holes 114 and 115 are also important to the spacing between the applicator and the drum. For example, if the applicator is skewed around the x axis with respect to the drum (the drum and magnetic core axes are not parallel), the applicator will be closer to the drum in its middle compared to its ends. Rotation about the z axis also affects drum-applicator spacing because of the flat portion of the applicator facing the drum.

Figure 14:
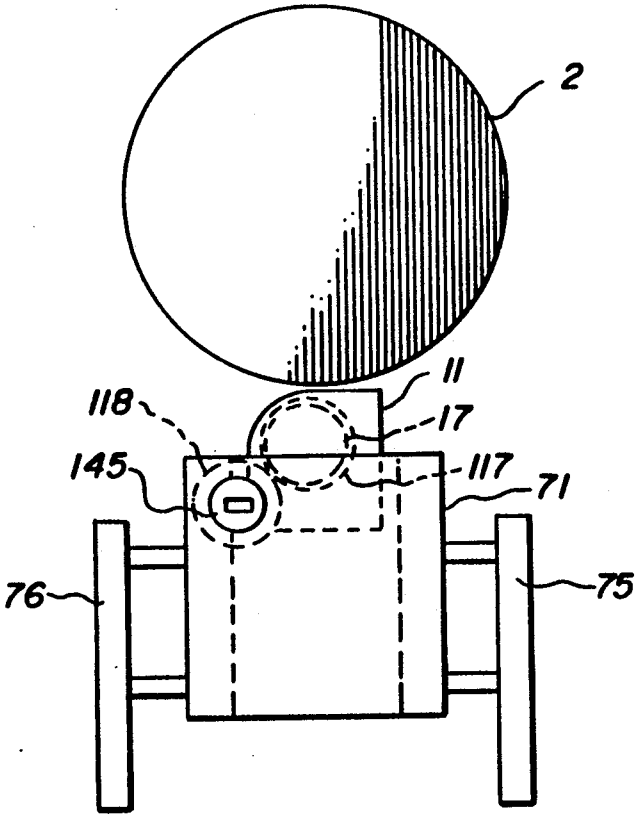
FIG. 14 is a front view similar to FIG. 7 illustrating gearing for the drive for the applicator shown in FIG. 5.

In the FIG. 1 embodiment, the shaft 45 for rotatable magnetic core 17 extends along the same axis through universal coupling 46 to gear box 61. As shown in FIGS. 5 and 8, such an extended shaft would encounter either pin 110 or pin 111. This problem can be handled in at least two ways. First, block 71 can be raised to a position substantially above shaft 45 with shaft 45 exiting through it and holes 114 and 115 being positioned above shaft 45. A second solution is shown in FIGS. 5 and 14. Referring to FIG. 14, rotatable magnetic core 17 is driven by a coaxial gear 117 fixed to its shaft. Gear 117 in turn is driven by a drive shaft 145 through a coaxial gear 118 fixed to it. This allows shaft 145 to be offset from pin 110 as shown in FIG. 5.

FIG. 15 illustrates a preferred lifter 80 particularly useable with highly accurate positioning mechanism such as that shown in FIGS. 5–11. For highest accuracy, block 71 must be free for some rotary and linear movement with respect to all three axes (see FIG. 5). According to FIG. 15, lifter 80 includes a rod 180 having a stationary ball 181 fixed to its end. Ball 181 fits in a spherical socket in socket member 182 to form a ball joint permitting universal angular movement of socket member 182. The top of socket member 182 is smooth and flat and slides on the bottom surface of block 71. Lifter 80 is moved in an upward direction in response to rotation of a separately driven cam 200 which engages engaging pin 83. Block 71 is free to adjust both rotationally and linearly with respect to all three axes as socket member 182 maintains its flat sliding contact with block 71. As shown in FIG. 15, block 71 seats accurately with respect to drum 2 using the positioning means shown in FIGS. 5 through 11. Pins 110 and 111 are eliminated from FIG. 15 for clarity of illustration, but roller 112 is shown in engagement with drum 2. Block 71 has adjusted slightly to the right and tilted slightly with respect to side walls 75 and 76 as permitted by ball 181 and socket member 182. Use of a separately driven cam 200 for moving lifters 80 upward is preferred for the FIGS. 5–15 embodiment, because any translational movement of pins 110 and 111 before withdrawal is prevented by holes 114 and 115.

The applicators shown in these embodiments include a rotatable magnetic core and stationary shell. Other known applicators, both magnetic and nonmagnetic, touching drum 2 in operation or spaced from it can be used. For example,, a stationary magnetic core and rotating shell system or a single component nonmagnetic toning system, which typically involves applicator contact with drum 2 could be used. Precise location of the axis of rotation of such a contacting applicator with respect to the image member is important in such systems because that determines the pressure between the contacting surfaces and especially the evenness of such pressure.

In the FIGS. 1 and 2 embodiments, the supply of toner is shown as part of the development station. This requires replacement of the station when the supply of toner is exhausted or, alternatively, hand replacement of toner. An alternative approach is to have a separate supply of toner above an extended end of each unit which supply is replaceable without replacing the unit. This approach is conventional in copying apparatus. Obviously, the supply for the black unit 40 could be larger than the supply for the other three units.

The invention has been described in detail with particular reference to a preferred embodiment thereof, but it will be understood that variations and modifications can be effected within the spirit and scope of the invention as described hereinabove and as defined in the appended claims.

We claim:

1. A developing device for applying toner to an electrostatic image carried on an image member as said electrostatic image moves through a developing position, said developing device comprising a plurality of developing units, each unit including an applicator which applicator includes rotatable means for moving dry particulate developer through the developing position and a housing which housing includes means for supplying such dry particulate developer to said applicator, characterized in that each of said units is movable to a position aligned with said developing position, and each of said applicators is movable toward and away from said developing position with respect to said means for supplying.

2. A developing device according to claim 1 wherein said developing units are movable as a unitary component through a path which aligns each unit with the developing position one after another to tone a series of electrostatic images with different toners.

3. A developing device according to claim 2 including means for moving the applicator of a developing unit toward said developing position in response to its unit becoming aligned with said developing position.

4. A developing device according to claim 2 wherein each unit includes a toner of a color different from that of each other unit.

5. A developing device according to claim 2 wherein three of said units are part of a single unitary removable component, said units carrying three different color non-black toners and a fourth unit is separately removable and contains black toner.

6. A developing device according to claim 2 wherein all of said units are part of a single unitary component.

7. A developing device for applying color toners to electrostatic images carried by a moving image member as said images move through a single fixed development position, said developing device comprising:

a plurality of developing units, each unit containing a toner of a color different from the other units, each of said units including an applicator assembly mounted in said unit and movable toward and away from the development position with respect to a portion of said unit, each applicator assembly including a magnetic core and a nonmagnetic shell, at least one of said core and shell being rotatable to move developer having a magnetic component around said shell and through a development position in developing relation with an electrostatic image carried by said image member, and means for moving said units as a group through a path that aligns each unit with said developing position, one after another.

8. Developing device according to claim 7 including means for moving each applicator assembly, which moving means includes a ramp generally opposite said developing position along the path of said units and means associated with each unit for engaging said ramp as said unit becomes aligned with said development position and for moving each applicator assembly toward said development position in response to such engagement.

9. Developing device according to claim 7 wherein said portion of each unit includes a chamber for holding developer, said chamber having an opening in which said applicator assembly is positioned, and said portion further including means for mixing developer in said chamber and for supplying developer to said applicator assembly.

10. A developing device according to claim 9 including means for moving the applicator assembly of a developing unit aligned with the developing position toward the developing position.

11. A developing device for applying color toners to electrostatic images carried by the surface of an image member as said image member moves through a single fixed development position, said developing device comprising:

a plurality of development units, each unit containing a dry developer including a toner of a color different from the other units, and each unit including an applicator assembly and a mixing device mounted in the unit, said applicator assembly being movable toward and away from the mixing device, and said units being fixed in a side-by-side arrangement in a movable carriage, said carriage being movable in a lateral direction bringing the applicator of each unit through a position in which it is aligned with said development position.

12. Developing device according to claim 11 wherein said mixing device includes a rotatable paddle which paddle is positioned below said applicator and rotation of which causes the level of developer in said chamber to rise making developer available to said applicator.

13. Developing device according to claim 11 wherein each unit includes means for supplying developer to its applicator assembly and said applicator assembly is movable toward and away from said supplying means.

14. Developing device according to claim 13 wherein said supplying means is a rotatable paddle positioned in a chamber for mixing a quantity of developer in said chamber, such mixing raising of level of developer in said chamber to supply it to said applicator assembly.

15. Developing device according to claim 14 wherein said applicator assembly includes a magnetic core and a sleeve around said core, at least one of said core and sleeve being rotatable to transport developer having a magnetic component through said development position.

16. An electrostatographic apparatus having a photoconductive drum rotatable past a series of stations including charging and exposing stations for creating a series of electrostatic images on said drum and a development station for toning said series of electrostatic images with dry toners of different colors to create a series of single color toner images of different color and a transfer station for transferring said color toner images to a receiving surface in registration to create a multicolor toner image, said developing station including:

a plurality of developing units, each unit including an applicator including magnetic means for moving developer having a magnetic component through toner applying relation with an electrostatic image and means for supplying such developer to said applicator, a carriage for holding said units fixed with respect to each other, said carriage being movable through a path bringing each unit, one after another into alignment with an operative position with respect to said drum, and means for moving the applicator of a development unit into said operative position with said drum by moving said applicator toward said drum relative to the developer supplying means in the applicator's respective unit.

17. Apparatus according to claim 16 further including an applicator support upon which said applicator is mounted, which support is slidable relative to said unit in response to said applicator moving means.

18. Apparatus according to claim 16 further including an applicator support upon which said applicator is mounted and which support is pivotable to move said applicator toward said drum in response to said applicator moving means.

19. Apparatus according to claim 16 further including means associated with said photoconductive drum for spacing the applicator of a positioned developing unit a predetermined distance from said drum at said development position, and further wherein each of said applicators includes means for engaging said spacing means in response to movement of said applicator toward said drum to space said applicator from said drum.

20. Apparatus according to claim 16 wherein said means for moving the applicator toward said development position is a wedge located generally opposite said drum and further wherein each unit has means for engaging said wedge, which engaging means is movable toward said drum by such engagement and wherein said applicator is movable toward said drum in response to such movement of said engaging means.

21. Apparatus according to claim 20 wherein said wedge is movable between a position in which it is in the path of said engaging means as said carriage is moved along its path and a position out of said engaging means path and wherein said carriage is movable in a first direction to position each of said development units in developing relation with said drum and in a second opposite direction and wherein said apparatus includes means for moving said wedge to its position out of said path when said carriage is moving or to be moved in its second direction.

22. A developing device for applying toner to an electrostatic image carried on an image member as said image moves through a development position, said developing device comprising:

a laterally movable carriage, a plurality of developing units fixed in a lateral side-by-side relationship in said carriage, each unit having a developer chamber for holding a dry, two-component developer having a magnetic component, means in said chamber for mixing developer and an applicator positioned in an opening from the chamber, said applicator including magnetic means for presenting developer to said development position, means for driving said carriage laterally to move each unit through a position in which it is aligned with said development position, and means for moving the applicator of each unit away from its mixing means toward said development position as such unit is positioned in alignment with said development position.

23. A developing device for applying toner to an electrostatic image carried on an image drum as said image moves through a development position located generally at the bottom of said drum, said development device comprising:

a plurality of developing units, fixed in horizontal side-by-side relation on a movable carriage, each unit having a development chamber for holding dry, two-component developer, means for mixing developer in said chamber and an applicator at the top of the chamber having a magnetic means for presenting developer including a magnetic component to the development position, means for driving said carriage through a generally horizontal path to move each unit, one after another, through a position directly blow the development position, and means for moving the applicator of each unit relative to its mixing means in an upward direction as its unit is positioned below said development position by said driving means.

24. A developing device according to claim 23 including a control means for controlling the driving means to drive said carriage from a start position in a first direction and to stop said carriage with each unit directly below said development position for enough time for each unit to develop a single electrostatic image carried by said drum and after all units have developed an electrostatic image to move said carriage back to said start position.

25. A developing device according to claim 23 wherein said means for moving the applicator of each unit is a wedge located directly below said development position and means associated with each unit for engaging said wedge as said unit becomes positioned below said development position for moving said applicator upward in response to engaging said wedge.

26. A developing device according to claim 25 wherein said engaging means includes a releasable spring for moving said applicator and means for releasing said spring in response to engagement of said wedge.

27. A developing device comprising a carriage, a plurality of developing units arranged side by side on said carriage means for moving said carriage in a lateral direction to move said units one after another into a position aligned with a development position of an image member, means for moving a portion of an aligned unit in a direction transverse to the lateral direction and away from the rest of the unit and into operative relation with an image member at said development position, said means for moving a portion of an aligned unit in a transverse direction including a wedge located generally opposite said developing device from said development position and an engaging means on each developing unit positioned to engage said wedge as its unit becomes aligned with the developing position, and means associated with each unit for moving said portion of said unit into operative relation with said drum at said developing position in response to engagement of said wedge by said engaging means.

28. A development device according to claim 27 wherein said portion is an applicator having a rotatable magnetic core.

29. A developing unit including a housing for holding a supply of developer, said housing having an opening, an applicator block positioned in said opening and an applicator supported by said applicator block for applying developer from said housing to an electrostatic image outside said housing, said block and applicator being movable away from said supply of developer from a recessed position to an extended position in which extended position said applicator is operative for applying developer to an electrostatic image, and flexible sealing means between said block and said housing for preventing the escape of developer from said housing but permitting relative movement between said block and housing.

30. A developing unit according to claim 29 wherein said flexible seal includes bellows between said block and housing.

31. A color printer or copier having a rotatable drum, means for forming a series of electrostatic images on said drum and a developing device for developing each of said series of images with toner of a color different from each of said other images, said developing device including a plurality of developing units each unit including a housing for holding a supply of developer, said housing having an opening, an applicator block positioned in said opening and an applicator supported by said applicator block for applying developer from said housing to an electrostatic image outside said housing, said block and applicator being movable away from said supply of developer from a recessed position to an extended position in which extended position said applicator is operative for applying developer to an electrostatic image, and flexible sealing means between said block and said housing for preventing the escape of developer from said housing but permitting relative movement between said block and housing, and said developing device further including means for moving said units one after another into alignment with said drum and means for moving the block of an aligned unit to its extended position to bring its applicator into developing relation with an electrostatic image carried by said drum.

32. A method of developing an electrostatic image carried on a surface utilizing a developing unit having a supply of a developer having a dry particulate magnetic component, an applicator including magnetic means for moving the developer and a developer supply means for supplying developer to said applicator, said method comprising:

moving said surface to transport said electrostatic image through a development position, moving said applicator away from said supply means and into developing relation with said electrostatic image at said development position, and actuating said applicator and supply means to move developer through said development position to develop said electrostatic image.

33. The method according to claim 32 further including the step of aligning said development unit with said development position.

34. A developing unit for applying toner to an electrostatic image from a supply of dry particulate developer having a magnetic component, said unit including a housing for holding said supply of developer, said housing having an opening, an applicator block positioned in said opening and an applicator supported by said applicator block and having magnetic means for applying developer from said housing to an electrostatic image outside said housing, said block and applicator being movable away from said supply of developer from a recessed position to an extended position in which extended position said applicator is operative for applying developer from said supply to an electrostatic image, spring means urging said block toward its extended position, and means for controlling the application of said spring to said block to control the position of the block between its recessed and extended positions.

35. A developing unit for applying toner to an electrostatic image from a supply of dry particulate developer having a magnetic component, said unit including an applicator having a magnetic core and a nonmagnetic shell, at least one of said core and shell being rotatable to move the developer through development relation with the electrostatic image, said applicator being movable away from said supply of developer from a recessed position to an extended position in which extended position said applicator is operative for applying developer to the electrostatic image.

36. A developing unit according to claim 35 further including spring means urging said applicator toward its extended position, and means for controlling said spring means to control movement of said applicator between it extended and recessed positions.

37. A developing unit according to claim 36 including means defining a chamber for said supply of developer, means for mixing said developer in said chamber and for raising the level of developer in said chamber to a position at which it is attracted by the magnetic core in said applicator.

* * * * *

UNITED STATES PATENT AND TRADEMARK OFFICE

CERTIFICATE OF CORRECTION

PATENT NO. : 5,182,608

DATED : January 26, 1993

INVENTOR(S) : Arthur S. Kroll et al

It is certified that error appears in the above-indentified patent and that said Letters Patent is hereby corrected as shown below:

On the title page, item [57] Abstract, line 5, delete "is" and substitute --in--.

Column 13, line 40, delete "blow" and substitute --below--.

Column 14, line 1, after "carriage" insert a comma --,--.

Signed and Sealed this

Twenty-second Day of February, 1994

Bruce Lehman

*Attest:*

BRUCE LEHMAN

*Attesting Officer*

*Commissioner of Patents and Trademarks*